US006689524B2

(12) United States Patent
Ohmura et al.

(10) Patent No.: US 6,689,524 B2
(45) Date of Patent: Feb. 10, 2004

(54) TONER FOR DEVELOPING A STATIC LATENT IMAGE AND IMAGE FORMING APPARATUS

(75) Inventors: Ken Ohmura, Hachioji (JP); Naohiro Hirose, Hachioji (JP); Hiroshi Yamazaki, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/163,961

(22) Filed: Jun. 5, 2002

(65) Prior Publication Data

US 2003/0022082 A1 Jan. 30, 2003

(30) Foreign Application Priority Data

Jun. 7, 2001 (JP) ..... 2001-172489

(51) Int. Cl.[7] ..... G03G 15/20; G03G 9/08
(52) U.S. Cl. ..... 430/105; 430/111.4; 399/335
(58) Field of Search ..... 430/105, 109.3, 430/137.14, 137.15; 399/335

(56) References Cited

U.S. PATENT DOCUMENTS

| | | | | |
|---|---|---|---|---|
| 6,337,169 | B1 * | 1/2002 | Hashimoto et al. | 430/126 |
| 6,395,442 | B1 * | 5/2002 | Hayashi et al. | 430/109.4 |
| 2001/0003560 | A1 * | 6/2001 | Yokosuka et al. | 399/69 |
| 2002/0110745 | A1 * | 8/2002 | Ohmura et al. | 430/107.1 |

* cited by examiner

*Primary Examiner*—John Goodrow
(74) *Attorney, Agent, or Firm*—Squire, Sanders & Dempsey

(57) ABSTRACT

The present invention relates to a toner for developing a static latent image, wherein a smell of the toner has a cos θ of from 0.990 to 0.998 as to the smell of styrene and a cos θ of from 0.986 to 0.994 as to the smell of n-butyl acrylate in the smell space formed by styrene and n-butyl acrylate, and a toner for developing a static latent image, wherein a smell of the toner has a cos θ of from 0.990 to 0.998 as to the smell of styrene and a cos θ of from 0.991 to 0.999 as to the smell of mercaptocarboxylic acid ester in the smell space formed by styrene and mercaptocarboxylic acid ester.

4 Claims, 3 Drawing Sheets

TONER FOR DEVELOPING A STATIC LATENT IMAGE AND IMAGE FORMING APPARATUS

FIELD OF THE INVENTION

The invention relates to a toner for developing a static latent image to be used as a copy machine and a printer, and an image forming apparatus.

BACKGROUND OF THE INVENTION

An impurity, particularly a low molecular weight ingredient having a smell, contained in a toner for developing a static latent image usually used in electrophotography tends to cause an undesirable condition such as giving off an unpleasant odor when the container of the toner is opened at the time of the use of the toner.

A heat-fixing method is usually applied for fixing a toner image onto a copy paper sheet. A heat-roller fixing method is widely used as the heat-fixing. Such the method is extremely suitable for fixing since the heat efficiency for fusing the toner image to adhere it onto the image receiving element is very high and the image can be rapidly fixed.

In some cases, however, an unpleasant odor is given to the operator since the toner image is heated so as to release a very small quantity ingredient contained in the toner. Recently, the chance of to use the copy machine or the printer near a person such as in an office is considerably increased. The chance of the domestic use of such the apparatus is also increased. Consequently, the case is increased in which the odor given off from the toner gives unpleasant feeling to the using person using it. The social concern with the smell is recently raised and the bad odor tends to be extremely evaded even though the fragrant is liked.

One cause of the bad odor given off from the electrophotographic apparatus is generation of ozone by corona discharge. However, the odor of ozone is dramatically reduced by technological innovation such as the development of a contact charging method using a roller charging or a brush charging or of a corona charging device in which the ozone generation is considerably inhibited. Consequently, the case of the unpleasant feeling caused by the toner odor is relatively increased.

In a case, a filter for absorbing the odor is attached with the apparatus. However, such the means accompanies a disadvantage in the production cost and a trouble as to the maintenance of the deodorizing function such as periodical exchange of the filter.

A method by means of reducing the impurity in the binder resin has been known as the means for decreasing the odor caused by the toner. For example, Japanese Patent Publication Open to Public Inspection, hereinafter referred to as JP. O.P.I, Nos. 64-70765, 64-88556 and 8-328311 each proposes decreasing the odor by reducing the monomer remained in the binder resin. JP O.P.I. Nos. 7-104515 and 7-104514 each describes that the reducing of the evaporative ingredient is insufficient to inhibit the toner odor and a technology to remove the odor of the raw material since the evaporative matter formed by decomposition of an chemically instable substance contained in a very small amount in the raw material of the binder resin.

JP O.P.I. No. 8-171234 describes that the causing substance of the odor is an oxidation product of benzaldehyde contained in the toner, and discloses the trial for reducing content of benzaldehyde. Moreover, JP O.P.I. No. 9-230628 describes a contrivance for reducing the odor without bad influence on the fixing ability of the toner by reducing the using amount of alkyl mercaptane until the minimum amount necessary for making the basic property of the toner.

JP O.P.I. No. 3-105350 describes an attempt to add an alkyl betaine compound to the toner as a substance capable of reacting with or absorbing the odor substance. Furthermore, JP O.P.I. No. 2-240663 describes a deodorizing method by which the toner is contacted with a deodorant for 5 hours or more in the processes of crashing and classifying of the toner. However, a long producing time is required and the odor given off after the production cannot be reduced by this method.

The countermeasures by the foregoing methods accompany with difficulty since the amount of the odor substance capable of being perceived by man is very small.

It is important, however, to consider the problem of the odor from the viewpoint of that it is difficult to judge the odor is perceived by man as a good smell (fragrant) or a bad odor and a non-smell condition is pleasant or not for man since the perception of man is delicate.

From such the viewpoint, it is necessary to known a technology for precisely evaluating and designing the quality of the odor caused by the extremely small amount of the contained substance according to a objective norm, and to know that what smell given off in what degree is perceived by man as pleasant smell according to the evaluation and the design.

The object of the invention is to precisely evaluate and design the smell given off from the image forming apparatus such as the copy machine or the printer, which are become to be frequently used near man, and to make the smell to a pleasant smell for man. The evaluation and the design of the toner is previously carried out from the viewpoint of that the pleasant smell is given off in the image forming process since the major cause of the smell given off from the image forming apparatus is the toner for developing the static latent image.

SUMMARY OF THE INVENTION

A method is found by the inventors, by which a slight and delicate smell can be objectively evaluated and the standard of the pleasant smell can be defined according to the results of the evaluation. Thus the invention can be attained.

The object of the invention can be achieved by applying any one of the following constituents.

1. A toner for developing a static latent image, wherein a smell of the toner has a cos θ of from 0.990 to 0.998 as to the smell of styrene and a cos θ of from 0.986 to 0.994 as to the smell of n-butyl acrylate in the smell space formed by styrene and n-butyl acrylate.

2. A toner for developing a static latent image, wherein a smell of the toner has a cos θ of from 0.990 to 0.998 as to the smell of styrene and a cos θ of from 0.991 to 0.999 as to the smell of mercaptocarboxylic acid ester in the smell space formed by styrene and mercaptocarboxylic acid ester.

3. An image forming apparatus fixing a toner image onto a recording material by heating, wherein the image forming apparatus emits a fragrant smell having a cos θ of from 0.990 to 0.998 as to the smell of styrene and a cos θ of from 0.986 to 0.994 as to the smell of n-butyl acrylate in the smell space formed by styrene and n-butyl acrylate.

4. An image forming apparatus fixing a toner image on to a recording material by heating, wherein the image forming apparatus emits a fragrant smell having a cos θ of from 0.990 to 0.998 as to the smell of styrene and a cos θ of from 0.991 to 0.999 as to the smell of mercaptocarboxylic acid ester in the smell space formed by styrene and mercaptocarboxylic acid ester.

DETAILED DESCRIPTION OF THE INVENTION

The angle between the vector of the smell causing substance and that of a sample is determined and the cosine of the angle cos θ is calculated. It can be considered that the smell of the sample is nearer the smell of the smell causing substance when the angle of the vector is smaller or the value of the cos θ is larger.

For example, when the vectors of Toner A and Toner B and the reference substance are as shown in FIG. 1, cos θ B is larger than cos θ A in this case. Consequently, it can be concluded that the smell of Toner B is nearer the smell of the reference substance than the smell of Toner A.

In the invention, styrene, a mercatocarboxylic acid ester and n-butyl acrylate are used as the reference substance. As the mercaptocarboxylic acid ester, n-octyl-3-mercaptopropionic acid ester is used.

It has been found by the inventors that a smell different in some degree from, not the same as, the smells of these reference substances is a pleasant smell source so that the working efficiency can be raised. Furthermore, it has been unexpectedly found that the working efficiency is also lowered when the smell is largely different from that of the reference substance. It is considered that the working efficiency is lowered by a sense of incompatibility caused by the smell different from that usually perceived from the copy machine of the printer customarily used even though the reason of such the effect is not cleared yet. It is supposed that the working efficiency of man can be raised by giving the slightly different smell without feeling of the smell difference. Consequently, it is concluded that it is important to control the smell of the toner so that the gradient of the vector as to the reference substance cos θ is within the specified range. Thus the object of the invention is attained.

The working efficiency of man is lowered when the smell is without the range.

The cos θ as to the reference samples in the smell space represents the cos θ measured by the following method.

As the sample for measuring, 0.1 g of a toner is put into a sample bag made of poly(ethylene terephthalate) having a volume of 2 liter.

The sample bag is filled by nitrogen and the bag including the toner is heated for 30 seconds by a hot plate heated at 160° C.

Preparation of Reference Sample

Reference sample of styrene smell: In a 2 liter sample bag, 0.2 ml of saturated styrene gas is put and diluted by nitrogen gas.

The saturated gas is gas taken near the liquid surface in the bottle by a micro syringe. The bottle is stored at an ordinary temperature under a closed condition.

Reference sample of n-butyl acrylate smell: In a 2 liter sample bag, 0.2 ml of saturated n-butyl acrylate gas is put and diluted by nitrogen gas.

Reference sample of mercaptocarboxylic acid ester smell: n-octyl-3-mercaptopropionic acid ester is used as the reference substance. In a 2 liter sample bag, 0.5 ml of saturated n-octyl-3-mercaptopropionic acid ester gas is put and diluted by nitrogen gas. Then the bag is stood for 1 hour.

Measuring Condition

Measuring Apparatus: Fragrance & Flavor Analyzer FF-1 Manufactured by Shimazu Seisakusyo Co., Ltd.

Temperature of sensor chamber: 60° C.

Current amount of sampling: 165 ml/min.

Preliminary sampling period: 10 sec.

Sampling period: 45 sec.

Temperature of collecting tube: 40° C.

Dry Purge

Temperature: 40° C.

Current amount: 500 ml/min.

Period: 45 sec.

Desorption

Temperature of collecting tube: 220° C.

Current amount: 20 ml/sec

Period: 90 sec.

Measuring times for one sample: 5

BRIEF DESCRIPTION OF THE DRAWINGS

1. Vector of the smell of Toner A
2. Vector of the smell of the reference substance
3. Vector of the smell of Toner B

Figure 1:
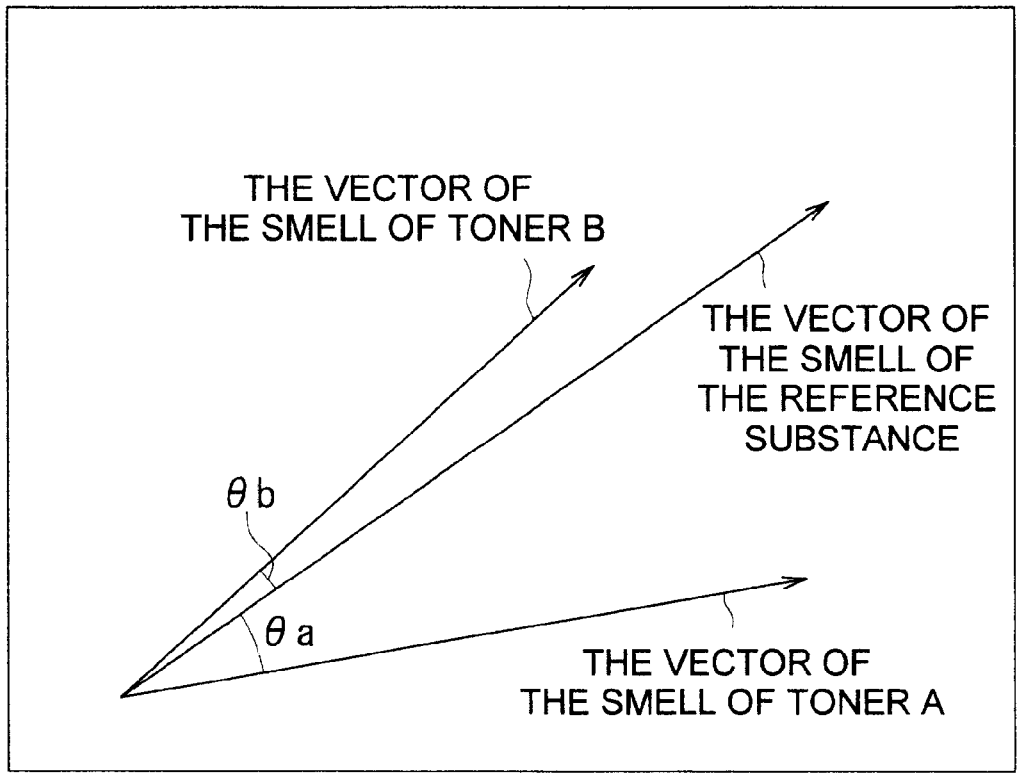
FIG. 1 shows the vector of the smell of the toner together with that of the reference substance.

1. Semiconductor laser light source
2. Polygon mirror
3. fθ lens
4. Photoreceptor
5. Charging device
6. Developing device
7. Transferring device
8. Recording element (Image support)
9. Separation device
10. Fixing device
11. Cleaning device
12. Exposure before charging (PCL)
13. Cleaning blade

DETAILED DESCRIPTION OF THE INVENTION

The materials, the production method and the image forming apparatus usable in the invention are described below in detail.

A method can be applied to attain the smell according to the invention, by which the smell containing the reference substance is reduced so as to be within the specific range by the use of a deodorant. A toner prepared by a polymerization method by which the resin is synthesized in water is preferred rather than a toner prepared by a crushing method by which the resin and the colorant are fused, kneaded and crushed, even though there is no limitation on the method for preparing the toner itself, since the toner prepared by the polymerization method is easily deodorized.

The deodorant to deodorize the unpleasant and unnecessary odor is described bellow.

Extracted Matter of Plant

The extracted matter of plant is an extract or an extracted ingredient originated in plant or an aqueous dispersion of a synthesized substance having a structure the same as the extracted ingredient of plant. In the invention, one capable of deodorizing a sulfur-containing odor substance is preferable as the deodorizing material regarding the extract of plant. For example, a plant extract such as a green tea extract, condensed persimmon tannin and a bamboo extract is preferable. These materials convert hydrogen sulfide or mercaptane to convert to non-odor molecular by chemical decomposition or deodorize the odor molecular by inclusion.

When the deodorant containing a plant extract preferably usable in the invention is prepared from green tea, the crushed raw leaf of green tea is immersed in ethanol. Thus obtained ethanol extract which contains a catechin, a vitamin, a sugar and an enzyme is filtered and concentrated to obtain the deodorant containing the plant extract relating to the invention.

In concrete, the deodorant is one prepared by extracting the raw leaves of green tea by ethanol at a temperature of not more than 80° C., for example, from 50 to 70° C. This solution contains an ethanol-soluble ingredient and a water-soluble ingredient contained in the raw leaf of green tea. The ethanol extract contains a flavanol such as (−)-epicatechin (EC), (−)-epigallocatechin (EgC), (−)-epicatechin gallate (ECg) and (−)-epigallocatechin gallate (EGCg), an enzyme such as an oxidation-reduction enzyme, a transfer enzyme, a hydrolytic enzyme and an isomerase, a glycoside of a flravonol such as flavone, isoflavone, flavonol, flavanone, flavalyl, Orlon, anthoamidine, chalcone and dihydrochalcone, caffeine, an amino acid, a flavandiol, a polysaccharide, a protein and a vitamin, which are almost the same as in the green tea extract. The ingredients of the raw leaf of tea are varied depending on the weather, the atmospheric temperature, the harvest time and the harvest region. Therefore, it is preferable to add synthesized and purified vitamins C and B1 to the ethanol extract in an amount of from 1 to 2% by weight of the solid ingredient contained in the extract for giving a constant and stable deodorizing period to the deodorant and for reinforcing the effect and the ability of the deodorant.

The deodorant relating to the invention is an alcoholic solution containing the catechins, vitamins, sugars and enzymes. The residue of the raw tea leaf after the extraction by alcohol may be contained in the foregoing deodorant. Accordingly, the deodorant relating to the invention can be produced by immersing the crashed raw tea leaves in alcohol for extracting the ingredients of the raw leaf of tea.

Another concrete example of deodorant containing an extract ingredient of plant includes a tree such as Japanese cypress, Aomori hiba, beech tree, cryptomeria, camphor tree and eucalyptus, a herb, mustard, Japanese horseradish, lemon, Chinese quince, mint, clove, Ceylon cinnamon, bamboo, rhizome of iriomote thistle and root of yaeyama palm. The extract or extracted ingredient can be obtained by subjecting the plant body to crashing, pressing, boiling or steam distilling. Concrete examples of the extracted ingredient of the plant or the synthesized substance having the structure the same as that of the ingredient of the extract of the plant include a tropolone such as hinokitiol, a monoterpene such as α-pinene, β-pinene, camphor, menthol, limonene, borneol, α-terpinene, γ-terpinene, α-terpineol, terpinene-4-ol and cineol, a sesquiterpene such as α-cadinol and t-muurolol, a polyphenol such as catechin and tannin, a naphthalene derivative such as trimethylnaphthalene, a long chain aliphatic alcohol such as citronellol, an aldehyde such as cinnamaldehyde, citral and perylaldehyde, and an allyl compound such as a allyl isocyanate. A pyroligneous acid obtained by baking wood is also usable in the invention. When the extracted ingredient of plant or the synthesized substance having the same structure as that of the extracted ingredient of plant is insoluble in water, they can be used in a form of an aqueous dispersion using a dispersant such as a surfactant.

Among the plant extract ingredient deodorants available on the market, for example, F118, manufactured by Fine 2 Co., Ltd., and Dersen, manufactured by Yuukou Yakuhin Kogyo Co., Ltd., are preferably used.

A phytontid deodorant in which at least one of the extract ingredients of plant is a phytontid, is mainly comprised of the plant extract containing the phytontid. The phytontid deodorant is prepared by adding an anionic surfactant, a glycol, a specific surfactant and a host compound to a natural macromolecular substance having a molecular weight of from 15,000 to 2,300,000, which is extracted from a coniferous tree. Such the deodorant completely decomposes chemically and converts the odor substance to another substance by neutralization and inclusion. Biodash D-200, manufactured by Daiso Co., Ltd., available on the market is preferably used.

Enzyme Type Deodorant

As to the deodorant containing an enzyme, many ones containing a biological oxidation enzyme, particularly a certain kind of metal-containing enzyme, have an ability of oxidation decomposing ammonia, an amine, hydrogen sulfide, a mercaptane, indole and a carbonyl compound. Almost all the molecules of the odor substance have a movable hydrogen atom. Therefore deodorization can be realized by dehydrogenating oxidation such the hydrogen atom so as to convert the odor substance to a dimer, an insoluble substance or a nonvolatile substance.

Concrete examples of the enzyme having the deodorant effect include catalase, amylase, protease, lipase, papain, cymopapain and pepsin. The catalase enzyme contains hematoporphyrin and is combined with an apoprotein, in which the electron of the iron atom is in a state of three-valent spin and the nitrogen atom of histidineimidazole is coordinated at the fifth coordination locus. Bio C, manufactured by Console Corporation, and Biodash, manufactured by Daiso Co., Ltd., are preferably used among the enzyme type deodorants available on the market. Metal-phthalocyanine and artificial enzyme type deodorant using the metal-phthalocyanine The metal-phthalocyanine type deodorant includes an artificial enzyme type deodorant containing the metal-phthalocyanine.

A metal-phthalocyanine derivative having a catalytic activity similar to that of natural enzyme catalase, preferably an iron complex of carboxyphthalocyanine, more preferably an iron complex of octacarboxyphthalocyanine, has an ability of decomposing the odor substance molecule by a reaction mechanism similar to that of catalase.

The use of the metal-phthalocyanine as the deodorant gives the following advantages on the odor decomposition of the odor:

1: The reaction speed and the decomposing efficiency are high
2: The reaction is progressed at an ordinary temperature
3: Possibility of environment prolusion is little since the reaction is carried out in an aqueous system.
4: The life of the catalyst if long since the reaction is a cyclic reaction.

An artificial enzyme can also be used as the deodorant, which is prepared by bonding the metal-phthalocyanine derivative with a macromolecular substance by an ionic bond. Cyclodextrin is preferably used as the concrete example of the macromolecular substance.

Microbe Deodorant

A deodorant using a culture medium liquid of microbe is used as the microbe type deodorant. Examples of the microbe include one of more kinds of microbe selected from Bacillus group, Enterobacter group, Streptococcus group, Rhizopus group and Aspergillus group. A microbe of Nitrosomonas group, Nitrobacter group or Pseudomonus group can also be preferably used. The microbe deodorant is produced by the following procedure: A mixture of composed of 10 parts by weight of the microbe, from 5 to 100 parts by weight of a sugar, from 0.1 to 50 parts by weight of a water-soluble nitrogen compound and from 1,000 to 50,000 parts by weight of water is incubated for a period of from 15 to 40 hours at a temperature of from 20 to 40° C. and an oxygen supplying amount of from 0.02 to 2.0 liter per minute. Then the liquid is subjected to a treatment by a centrifuge. Thus obtained supernatant liquid or the culture liquid is dried to obtain the deodorant. A porous powder such as sawdust may be added in an amount of from 20 to 300 parts by weight to the culture liquid for suspending the microbe. A liquid aldehyde such as glutaraldehyde may be used together with the microbe deodorant. The mixing with the liquid aldehyde is preferred since the deodorizing effect of the deodorant is further enhansed.

Concrete examples of the microbe preferably usable in the invention include a microbe of Bacillus group, particularly *Bacillus subtilis* (Institute of Applied Microbiology, hereinafter referred to as IAM, 1168), *Bacillus natto* (Institute for Fermentation Osaka hereinafter referred to as IFO, 3009) as the preferable microbe. Moreover, *Bacillus coagulas* (IAM 1115) and *Bacillus macerans* (IAM 1243) are also usable.

As the microbe of Enterobacter group, for example, *Enterobacter sakazaki* (IAM 12660) and *Enterobacter agglonerans* (IAM 12659) are usable.

As the microbe of Streptococcus group, for example, *Streptococcus faecalis* (IAM 1119), *Streptococcus cremoris* (IAM 1150) and *Streptococcus lactis* (IFO 12546) are usable.

As the microbe or mould of Rhizopus group, for example, *Rhizopus formosaensis* (IAM 6250) and *Rhizopus oryzae* (IAM6006) are usable.

As the microbe of Aspergillus group, for example, *Aspergillus oryzae* (IFO 4176) and *Aspergillus niger* (IFO 4066) are usable.

As the microbe of Nitrosomonas group, for example, *Nitrosomonas europaea* (IFO 4066) is usable.

As the microbe of Nitrobacter group, for example, *Nitrobacter agilis* (IFO 14297) is usable.

As the microbe of Pseudomonas, for example, *Pseudomonas caryophilli* (IFO 12950), *Pseudomonas statzeri* (IFO 3773) are usable.

The microbe deodorant contains the microbe in the dormancy state, an organic acid effective for deodorization, and the enzyme capable of decomposing an organic substance. The microbe converts sugar and alcohol to lactic acid, citric acid or malic acid and produces an enzyme such as amylase, protease and lipase so to decompose an organic substance being the source of odor.

Adsorption of the Deodorant onto the Toner Particle Surface

In the invention, it is preferred that the deodorant is adsorbed onto the surface of the toner particle to maintain the deodorant effect even when the odor ingredient of the toner is exuded out from the interior of the toner particle at the process of drying or after sealing.

When the toner is produced by a polymerization method and salted out and coagulated, it is preferable that the deodorant is dissolved or dispersed in the aqueous medium even though the method for adsorbing the deodorant onto the toner particle is not specifically limited. It is further preferable that the toner particle is treated by the deodorant liquid after removing adhered substances such as the surfactant and the salting-out agent in the later-mentioned filtering and washing processes of the toner. The concentration of the deodorant to be adsorbed is preferably from 0.01 to 10 ppm of the toner. When the amount of the deodorant is less than 0.01 ppm, endurance of the deodorant effect is insufficient and when the amount of the deodorant is more than 10 ppm, the charging property becomes instable.

The producing method of the toner for developing a static latent image according to the invention is described below.

Production Method of the Toner

There is no specific limitation on the production method of the toner relating to the invention. However, a polymerization method, namely a method by which a polymerizable monomer is polymerized in an aqueous medium to form the toner particle, is preferable since the treatment for deodorizing and giving a pleasant smell has a high freeness.

In the invention, the aqueous medium is a medium comprising from 50 to 100% by weight of water and from 0 to 50% by weight of an organic solvent. Example of the organic solvent includes methanol, ethanol, iso-propanol, butanol, acetone, methyl ethyl ketone and tetrahydrofuran. An alcohol type organic solvent capable of not dissolving the resin to be formed is preferred.

An example of production process of the toner relating to the invention is described below.

The production process of the toner is principally composed of the following processes.

1: A multi-step polymerization process (I) for producing a combined resin particle in which a mold releasing agent and/or crystalline polyester is contained in a portion (in the central portion or the intermediate layer) other than the outermost layer.

2: A salting-out/adhering process (II) for forming toner particle by salting-out/adhering the combined resin particles and colored particles.

3: A filtering and washing process for separating the toner particle from the dispersion system of the particle by filtration and removing the surfactant from the toner particle by washing 4: A drying process for drying the washed toner particle 5: A process for adding an external additive into the dried toner particle The steps are each described in detail below.

Multi-step Polymerization Process (I)

The multi-step polymerization process is a process to produce the combined resin particle by forming a covering layer composed of a polymer of the monomer on a resin particle by the multi-step polymerization.

In the invention, a three or more step polymerization process is preferred from the viewpoint of the production stability and the anti-crush strength of the product.

The two-step polymerization method and the tree-step polymerization method are described below as typical examples of the multi-step polymerization.

Two-step Polymerization Method

The two-step polymerization method is a method for producing the combined particle composed of a central or core portion or core comprising a resin having a high molecular weight and a mold releasing agent; and a outer layer or shell comprising a resin having a low molecular weight. Namely, the combined resin particle produced by the two-step polymerization method is composed of the core and one layer covering the core.

In concrete, a monomer solution is prepared by dissolving the mold releasing agent in the monomer L. The monomer solution is dispersed as oil droplets in an aqueous medium such as a surfactant solution. The dispersion is subjected to a polymerization treatment, the first polymerization step, to form a dispersion of high molecular weight resin particles each containing the mold releasing agent.

Then a polymerization initiator and a monomer L for forming a low molecular weight resin are added to the resin second polymerization step, is applied. The covering layer is formed on the surface of the resin particle by the polymerization of the monomer L in the presence of the resin particle.

(Three-step Polymerization Method)

The tree-step polymerization method is a method for forming a combined resin particle comprising a central portion or a core composed of a high molecular weight resin, an intermediate layer containing the mold releasing agent and an outer layer or a shell. Namely, the combined particle formed by the three-step polymerization method is composed of the core and the two covering layers.

In concrete, a dispersion of resin particles prepared by a usual polymerization treatment, the first polymerization step is added to an aqueous medium such as a surfactant solution. Then a monomer solution prepared by dissolving the mold releasing agent in the monomer M is dispersed into the foregoing aqueous system in a form of oil droplet and the system is subjected to a polymerization treatment, the second polymerization step, to form a covering layer or an intermediate layer comprising a resin, polymer of the monomer M, containing the mold releasing agent. Thus a dispersion of a combined resin particles composed of the high molecular weight resin and the intermediate molecular weight resin.

To thus obtained dispersion of combined resin particle, a polymerization initiator and a monomer L to obtain a low molecular weight resin are added. Then a polymerization treatment of the monomer L is applied in the presence of the combined resin particle to form a covering layer composed of a low molecular weight resin, a polymer of the monomer L, on the surface of the combined resin particle. The foregoing method is preferred since the mold releasing agent can be finely and uniformly dispersed by applying the second polymerization step.

The polymerization method suitable for forming the resin particle or the covering layer each containing the mold releasing agent includes the following method:

A monomer solution composed of the monomer and the mold releasing agent dissolved in the monomer is dispersed in a form of an oil droplet by applying mechanical energy in an aqueous medium in which a surfactant is dissolved in a concentration less than the critical micelle concentration.

The water-soluble polymerization initiator is added to thus obtained dispersion and the monomer is polymerized by a radical polymerization in each of the oil droplets, hereinafter such the method is referred to as "a mini-emulsion method".

This method is preferred since the effect of the invention can be enhanced. In the method, an oil-soluble polymerization initiator may be used in place of or together with the water-soluble polymerization initiator.

The mold releasing agent dissolved in the oil phase is not released from the oil by the mini-emulsion method in which the oil droplet is mechanically formed, different from a usual dispersing method. Consequently, a sufficient amount of the mold releasing agent can be introduced in the formed resin particle or the covering layer.

There is no specific limitation on the dispersing means for dispersing the oil droplet by mechanical energy. For example, a stirring apparatus having a high speed rotor Cleamix, manufactured by M-tech Co., Ltd., an ultrasonic dispersing apparatus, a mechanical homogenizer, Manton-Goulin homogenizer and a pressure homogenizer are usable. The diameter of the dispersed particle is from 10 to 1,000 nm, preferably from 50 to 1,000 nm, more preferably from 30 to 300 nm.

An emulsion polymerization method, a suspension polymerization method and a seed polymerization method may also be applied for forming the resin particle or the covering layer other than the foregoing mini-emulsion polymerization method. These polymerization methods can also be applied for forming the resin particle constituting the combined resin particle (core particle) or the covering layer each containing no mold releasing agent and no crystalline polyester.

The diameter of the combined resin particle produced by the polymerization process I is preferably within the range of from 10 to 1,000 nm by weight average diameter measured by Electrophoresis Light Scattering Photometer ELS-800, manufactured by Otsuka Denshi Co., Ltd.

The glass transition point Tg of the combined resin particle is preferably within the range of from 48 to 74°, more preferably from 52 to 64°.

The softening point of the combined resin particle is preferably within the range of from 95 to 140° C.

Salting Out/fusion-aAdhering Process II

The process II is a process to obtain an irregular or non-sphere shaped toner particle by simultaneous salting-out and fusion-adhering of the combined resin particles and colorant particles.

The "salting-out" in the invention is a process in which the combined resin particles dispersed in the aqueous medium are coagulated by the effect of a salt. The "fusion-adhering" in the invention is a process to disappear the inter-particle surface between the particles coagulated by the salting-out. The "salting-out/fusion-adhering" means the simultaneous occurrence of the salting-out and the fusion-adhering or an action to simultaneously occur such the processes. For simultaneous occurrence of the salting-out and the fusion-adhere, it is necessary to coagulate the combined resin particles and the colorant particles at a temperature more than the glass transition temperature Tg of the resin constituting the combined resin particle.

In the salting-out/fusion-adhering process, an internal additive particle, fine particles having a number average diameter of primary particle of from 10 to 1,000 nm, of an additive such as a charge control agent may be salted out/fusion-adhered together with the combined resin particles and the colorant particles. The colorant particle may be one previously subjected to a surface modifying treatment. A known agent can be used for the surface modifying.

The colorant particle is subjected to the salting-out/fusion-adhering treatment in a state of dispersed in an aqueous medium. The aqueous medium in which the colorant particle is dispersed is preferably an aqueous solution in which a surfactant is dissolved in a concentration more than the critical micelle concentration.

Although there is no specific limitation on the dispersing means for dispersing the colorant particle, a medium type dispersing apparatus such as a stirring apparatus having a high speed rotor Cleamix, manufactured by M-tech Co., Ltd., an ultrasonic dispersing apparatus, a mechanical homogenizer, a pressure homogenizer such as Manton-Goulin homogenizer and a pressure homogenizer, Gettman mill and a diamond fine mill is usable.

It is necessary for salting-out/fusion-adhering the combined resin particles and the colorant particles to add a salting-out agent or a coagulation agent in a concentration of more than the critical coagulation concentration into the dispersion in which the combined resin particles and the colorant particles are dispersed, and to heat the dispersion by a temperature more than the glass transition temperature Tg.

The suitable temperature range for salting-out/fusion-adhering is from Tg+10° C. to Tg+50° C., preferably Tg+15° C. to Tg+40° C. A water-compatible organic solvent may be added for effective progression of the fusion-adhering.

Filtration and Washing Process

In the filtration and washing process, are applied a filtration treatment for separating toner particles by filtration from the toner particle dispersion obtained by the foregoing process, and a washing treatment for removing the substance adhered to the toner particle such as the surfactant and the salt-outing agent from the cake of the toner particles.

For the filtration treatment, a centrifuge, a vacuum filtration using a Nutsche funnel and a filtration using a filter press are applicable without any limitation.

(Drying Process)

This process is a process for drying the washed toner particles.

A spray dryer, a vacuum freezing dryer a vacuum dryer are usable in this process. A fixed rack dryer, a movable rack dryer, a fluid bed dryer, a rotary dryer and a stirring dryer are preferably usable.

The moisture content of the dried toner particles is preferably not more than 5% by weight, more preferably not more than 2%.

When the dried toner particles are coagulated by a weak attractive force between the particles, the coagulum may be subjected to a powdering treatment. For the powdering, a mechanical powdering machine such as a jet mill, a Henschel mixer, a coffee mill and a food processor is usable.

The toner according to the invention is preferably produced by the following procedure. Namely, the combined resin particles are prepared in the presence of no colorant and a dispersion of the colorant particle is added to the dispersion of the combined resin particle. Thereafter, the combined resin particles and the colorant particles are salted out/fusion adhered.

The polymerization reaction to form the combined resin particle is not hindered since the combined resin particle is produced in a system without the presence of the colorant. Consequently, the anti-offset ability is not degraded and the contamination of the fixing device and the image caused by accumulation of toner is prevented by the use of the toner according to the invention.

No monomer nor oligomer is remained in the toner particle since the polymerization reaction for forming the combined resin particle is surely progressed. Therefore, unpleasant odor is not occurred in the heat fixing process of the image forming apparatus using the toner.

Moreover, the image with a high sharpness can be obtained for a long period since the toner particles have a uniform surface property and a sharp charging amount distribution. In the image forming method comprising a contact heating fixing process, the anti-offset ability and the preventing ability for putting round to the fixing roller can be enhanced while a suitable adhesiveness to the image support or a high fixing strength of the toner image is maintained, and the image having a suitable glossiness can be obtained.

The constituents of the toner production process are described in detail below.

Polymerizable Monomer

A hydrophobic monomer is used as the essential constituent of the polymerizable monomer for forming the binder resin to be used in the invention. A monomer capable of cross-linking is used when it is necessary. It is preferable that at least one kind of monomer having an acidic polar group or a basic polar group is contained as later-mentioned.

(1) Hydrophobic Monomer

Known monomers can be used as the hydrophobic monomer constituting the monomer constituent without any limitation. One or more kinds of the monomers may be used in combination so as to satisfy the required property.

Concrete examples of the usable monomer include a mono-vinyl aromatic monomer, a (metha)acrylate monomer, a vinyl ester monomer, a vinyl ether monomer, a mono-olefin monomer, a di-olefin monomer and a halogenated olefin monomer.

Examples of the vinyl aromatic monomer include a styrene monomer and a derivative thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

Examples of the acryl monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

Examples of the vinyl ester monomer include vinyl acetate, vinyl propionate and vinyl benzoate.

Examples of the vinyl ether monomer include vinyl methyl ether, vinyl ethyl ether, vinyl isobutyl ether and vinyl phenyl ether.

Examples of the mono-olefin monomer include ethylene, propylene, isobutylene, 1-butene, 1-pentene and 4-methyl-1-pentene.

Examples of the di-olefin monomer include butadiene, isoprene and chloroprene.

(2) Monomer Capable of Cross-Linking

The monomer capable of cross-linking may be added to improve the property of the resin particle. Examples of the monomer capable of cross-linking include one having two or more unsaturated bonds such as divinylbenzene, dovinylnaphthalene, dovinyl ether, diethylene glycol methacrylate, ethylene glycol dimethacrylate, poly(ethylene glycol) dimethacrylate and diallyl phthalate.

(3) The Monomer having an Acidic Polar Group

Examples of the monomer having an acidic polar group include (a) an α,β-ethylenic unsaturated compound having a carboxyl group —COOH and (b) an α,β-ethylenic unsaturated compound having a sulfonic acid group —$SO_3H$.

Examples of the α,β-ethylenic unsaturated compound having the —COOH group of (a) include acrylic acid, methacrylic acid, fumaric acid, maleic acid, itaconic acid, cinnamic acid, monobutyl maleate, monooctyl maleate and their salts of a metal such as sodium and zinc.

Examples of the α,β-ethylenic unsaturated compound having the —$SO_3H$ group of (b) include sulfonated styrene and its sodium salt, allylsulfosuccinic acid, octyl allylsulfosuccinate and its sodium salt.

(4) The Monomer having a Basic Polar Group

Examples of the monomer having a basic polar group include (i) a methacrylate of a aliphatic alcohol having an amino group or an ammonium group and from 1 to 12, preferable from 2 to 8, particularly preferably 2, of carbon atoms, (ii) a (meth)acrylamide or a (meth)acrylamide optionally substituted by mono- or di-alkyl groups having from 1 to 18 carbon atoms on an N atoms, (iii) a vinyl compound substituted by a heterocyclic group having an N atoms as the member of the heterocyclic ring, and (iv) a N,N-diallylalkylamine and a quaternary ammonium salt thereof. Among them, the (meth)acrylate of the aliphatic alcohol having an amino group or a quaternary ammonium group of (i) is preferable as the monomer having a basic polar group.

Examples of the (meth)acrylate of the aliphatic alcohol having the amino group the quaternary ammonium group shown of (i) include dimethylaminoethyl acrylate, dimethylaminoethyl methacrylate, diethylaminoethyl acrylate, diethylaminoethyl methacrylate, quaternary ammonium salts of the foregoing four compounds, 3-dimethylaminophenyl acrylate and a 2-hydroxy-3-methacryl oxypropyltrimetylammonium salt.

Examples of the (meth)acrylamide or the (meth) acrylamide optionally substituted by mono- or di-alkyl groups of (ii) include acryl amide, N-butylacrylamide, N,N-dibutyacrylamide, piperidylacrylamide, methacrylamide, N-butylmethacrylamide, N,N-dimethylacrylamide and N-octadecylacrylamide.

Examples of the vinyl compound substituted by a heterocyclic group having an N atom as the member of the heterocyclic ring of (iii) include vinylpyridine, vinylpyrrolidone, vinyl-N-methylpyridinium chloride and vinyl-N-ethylpyridinium chloride.

Examples of the N,N-diallylalkylamine of (iv) include N,N-diallylmethylammonium chloride and N,N-diallylethyl-ammonium chloride.

Polymerization Initiator

A water-soluble radical polymerization initiator is optionally usable in the invention. Examples of such the initiator include a persulfate such as potassium persulfate and ammonium persulfate, an azo compound such as 4,4'-azobis4-cyanovalerianic acid and its salt, and a salt of 2,2'-azobis (2-amidinopropane) and a peroxide compound. The foregoing radical polymerization initiators may be used as redox type initiators in combination with a reducing agent. The use of the redox initiator is preferable since the polymerization activity is enhanced, the polymerization temperature can be lowered and the polymerization time can be shortened.

Although any temperature may be selected for the polymerization temperature as long as the temperature is more than the lowest radical generating temperature, a temperature within the range of from 50° C. to 90° C. is suitably applied. The polymerization can be carried out at an ordinary temperature or more by the use of a polymerization initiator capable of initiating the polymerization at an ordinary temperature such as the combination of hydrogen peroxide and a reducing agent such as ascorbic acid.

Chain-Transfer Agent: a Compound having a Mercapto Group

A known chain-transfer agent may be used for controlling the molecular weight. Although, there is no limitation on the chain-transfer agent, a compound having a mercapto group is particularly preferred since the toner having a sharp molecular weight distribution and excellent storage ability, fixing strength and anti-offset ability can be obtained by the use of such the compound. Examples of the compound include octylmercaptane, dodecylmercaptane and tert-dodecilmercaptane. For example, ethyl thioglycolate, butyl thioglycolate, t-butyl thioglycolate, 2-ethylhexyl thioglycolate, octyl thioglycolate, decyl thioglycolate, dodecyl thioglycolate, thioglycolic acid ester of ethylene glycol, thioglycolic acid ester of neopentyl glycol, thioglycolic acid ester of pentaerythritol are preferred. Among them, an ester of n-octyl-3-mercaptopropionic acid is particularly preferable.

Surfactant

When the mini-emulsion polymerization is performed using the foregoing polymerizable monomer, it is preferable that the monomer is dispersed as an oil droplet in the aqueous medium using a surfactant. The following ionic surfactants can be cited as examples of suitable compound even though there is no limitation on the surfactant.

Examples of the ionic surfactant include a sulfonic acid salt such sodium dodecylbenzenesulfonate, sodium arylalkylethersulfonate, sodium 3,3-disulfonediphenylurea-4,4-diazo-bis-amino-8-naphtholsulfonate and sodium 2,2,5,5-tetramethyl-triphenylmethane-4,4-diazo-bis-β-naphthol-6-sulfonate; a salt of sulfuric acid ester such as sodium dodecylsulfate, sodium tetradecylsulfate, sodium pentadecylsulfate and sodium octylsulfate; and a fatty acid salt such as sodium oleate, sodium laurate, sodium caprate, sodium caprylate, potassium stearate and potassium oleate.

A nonionic surfactant is also usable. Concrete examples include poly(ethylene oxide), poly(propylene oxide), a combination of poly(propylene oxide) and poly(ethylene oxide), an ester of a higher fatty acid and poly(ethylene glycol), an ester of a higher fatty acid and poly(propylene glycol) and a solbitol ester.

Although these surfactants are principally used in the invention as an emulsifier, the surfactants may be used for another process or another object.

Molecular Weight Distribution of the Resin Particle and the Toner

In the invention, the molecular weight distribution of the toner preferably has a peak or shoulder within the range of from 100,000 to 1,000,000. It is further preferable that the molecular weight distribution has the peaks or the shoulders within the ranges of from 100,000 to 1,000,000, from 25,000 to 50,000 and from 1,000 to 50,000.

A resin is preferred which contains at least a high molecular weight component having the peak or the shoulder within the range of from 100,000 to 1,000,000 and a low molecular weight component having the peak or the shoulder within the range of from 1,000 to less than 50,000. It is further preferable to add an intermediate molecular weight resin having the peak or the shoulder within the range of from 15,000 to 100,000.

The measurement by gel permeation chromatography (GPC) using tetrahydrofuran (THF) as the solvent is suitable for measuring the molecular weight of the toner or the resin. The measuring is carried out according to the following procedure. To a sample to be measured in an amount of from 0.5 to 5 mg, concretely 1 mg, 1.0 ml of THF and sufficiently dissolved by stirring by a stirrer such as a magnetic stirrer at an ordinary temperature. The solution is injected into the GPC apparatus after treatment by a membrane filter with a pore size of from 0.45 to 0.50 μm. The GPC is stabilized at 40° C., then THF is flowed in a rate of 1.0 ml per minute and 100 μl of the sample with a concentration of 1 mg/ml is injected for measuring. As the column, a combination of polystyrene gel columns available in the market is preferably used. Examples of the combination include a combination of Shodex GPC KF-801, 802, 803, 804, 805, 806 and 807, manufactured by Showa Denko Co., Ltd., and a combination of TSKgel G-1000H, G-2000H, G-3000H, G-4000H, G-5000H, G-6000H, G-7000H and TSK guard column, manufactured by Toso Co., Ltd. A refractive index detector (IR detector) or a UV detector is suitably used as the detector. In the measurement of the molecular weight, the molecular weight distribution of the sampled is calculated using a calibration curve prepared by using a monodisperse polystyrene standard particle. About 10 kinds of the standard polystyrene particle are suitably used for preparing the calibration curve.

Coagulant

A coagulant preferably used in the invention is selected from metal salts.

Examples of the metal salt include a salt of a mono-valent metal such as sodium, potassium and lithium; a di-valent metal such as an alkali-earth metal, for example, calcium and magnesium, and a di-valent salt of manganese and copper; and a tri-valent metal such as iron and aluminum.

Concrete examples of the mono-valent metal salt include sodium chloride, potassium chloride and lithium chloride; that of the di-valent metal salt include calcium chloride, zinc chloride, cupric sulfate, magnesium sulfate and manganese sulfate; and that of the tri-valent metal salt include aluminum chloride and ferric chloride. These salts may be optionally selected according to the purpose. Generally, the critical coagulation concentration (coagulation value or coagulation point) is of the di-valent metal salt is smaller than that of the mono-valent metal salt, that of the tri-valent metal salt is further small.

In the invention, the critical coagulation concentration is an index of the stability of the dispersion in the aqueous dispersion liquid, and shows the concentration at which the coagulation is occurred. The critical coagulation concentration is varied depending on the property of the latex itself and the dispersing agent. The critical coagulation concentration is described in S. Okamura, "Kobunsi Kagaku" 17, 601 (1960), and the value of the critical coagulation concentration can be known by the description of that. In another way, the salt to be measured is added into the particle dispersion in various concentrations and the ξ-potential of the dispersion is measured. The critical coagulation concentration of the salt can be decided according to the salt concentration at which the ξ-potential of the dispersion begins to vary.

In the invention, the polymer particle dispersion is treated using the metal salt so that the concentration of the metal salt is exceeded to the critical coagulation concentration. At this time, it is optionally selected according to the purpose that the metal salt is added directly or in a form of an aqueous solution. When the aqueous solution is used, it is necessary that the concentration of the salt in the dispersion is made so as to be larger than the critical coagulation concentration of the polymer particles.

The concentration of the metal salt as the coagulant in the invention is added to the dispersion so that the concentration thereof is become larger than the critical coagulation concentration, preferably 1.2 times or more, more preferably 1.5 times or more, of the critical coagulation concentration.

Colorant

The toner according to the invention is obtained by the salting-out/fusion-adhering of the combined resin particles with the colorant particles.

Various inorganic pigments, organic pigments and dyes can be used as the colorant (the colorant particle to be subjected to the salting-out/fusion-adhering treatment with the combined resin particle) constituting the toner according to the invention. Known inorganic pigments can be used. Concrete examples are described below.

For example, a carbon black such as furnace black, channel black, acetylene black, thermal black and lump black, and a magnetic powder such as magnetite and ferrite are usable as the black pigment.

These pigments may be used singly or in combination according to the requirement. The adding amount of the pigment is from 2 to 20%, preferably from 3 to 15%, by weight of the polymer.

The foregoing magnetite may be added when the toner is used as a magnetic toner. In such the case, it is preferable that the adding amount is from 20 to 60% by weight for giving the sufficient magnetic property.

Known organic pigment and dyes can be used. Concrete examples of the organic pigment and dye are shown below.

Examples of usable magenta or red pigment are as follows: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

Examples of usable orange or yellow pigment are as follows: C.I. Pigment Orange 31, C.I. Pigment Orange 43, C.I. Pigment Yellow 12, C.I. Pigment Yellow 13, Pigment Yellow 14, Pigment Yellow 15, Pigment Yellow 17, Pigment Yellow 93, Pigment Yellow 94, Pigment Yellow 138, Pigment Yellow180, Pigment Yellow 185, Pigment Yellow 155 and Pigment Yellow156.

Examples of usable green or blue pigment are as follows: C.I. Pigment Blue 15, C.I. Pigment Blue 15:2, C.I. Pigment Blue 15:3, C.I. Pigment Blue 16, C.I. Pigment Blue 60, C.I. Pigment Green 7.

Examples of usable dye are as follows: C.I. Solvent Red 1, 49, 52, 58, 63, 111 and 122, C.I. Solvent Yellow 19, 44, 77, 79, 81, 82, 93, 98, 103, 104, 112 and 162, and C.I. Solvent Blue 25, 36, 60, 70, 93 and 95. A mixture of these may be used.

The foregoing pigments and the dyes may be used singly or in combination according to necessity. The adding amount of the pigment is from 2 to 20%, preferably from 3 to 15%, by weight of the polymer.

The colorant constituting the toner according to the invention may be subjected to a surface modification. Known surface modifying agents can be used. In concrete, a silane coupling agent, a titanium coupling agent and an aluminum coupling agent are preferably used. Examples of the silane coupling agent include an alkoxysilane such as methyltrimethoxysilane, phenyltrimethoxysilane, methylphenyldimethoxysilane and diphenyldimethoxysilane; a siloxane such as hexamethyldisiloxane; γ-chloropropyltrimethoxysilane, vinyltrichlorosilane, vinyltrimethoxysilane, vinyltriethoxysilane, γ-methacryloxypropyl-trimethoxysilane, γ-glycidoxypropyl-trimethoxysilane, γ-mercaptopropyltrimethoxysilane, γ-aminopropyltriethoxysilane and γ-ureidopropyltriethoxysilane. Examples of the titanium coupling agent include TTS, 9S, 38S, 41B, 46B, 55, 138S and 238S each manufactured by Ajinomoto Co., Ltd. and sold in the marked with the trade name of Plenact, and A-1, B-1, TOT, TST, TAA, TAT, TLA, TOG, TBSTA, A-10, TBT, B-2, B-4, B-7, B-10, TBSTA-400, TTS TOA-30, TSDMA, TTAB and TTOP each manufactured by Nohon Soda Co., Ltd., and are available in the market. Examples of the aluminum coupling agent include Plenact AL-M manufactured by Ajinomoto Co., Ltd.

The adding amount of the surface modification agent is within the range of from 0.01 to 20%, preferably from 0.1 to 5%, of the colorant by weight.

The surface modification of the colorant particle can be performed by adding the surface modifying agent into the dispersion of the colorant particle and heating the system.

The surface modified colorant particles are took out by filtration and repeatedly subjected to washing by the same solvent and filtration. Then the colorant particles are dried.

Mold Releasing Agent

The toner to be used in the invention is preferably one produced by fusion-adhering the resin particles including a mold releasing agent in the aqueous medium. The toner in which the mold releasing agent is finely dispersed can be produced by salting-out/fusion-adhering the resin particles including a mold releasing agent with the colorant particles in the aqueous medium.

Low molecular weight polypropylene having a number average molecular weight of from 1,500 to 9,000 and low molecular weight polyethylene are preferably used as the mold releasing agent in the toner to be used in the invention. An ester compound represented by the following formula is particularly preferred.

$$R^1—(OCO—R^2)_n$$

In the formula, n is an integer of from 1 to 4, preferably from 2 to 4, more preferably from 3 to 4, particularly preferably 4; $R^1$ and $R^2$ are each a carbon hydride group which may have a substituent. $R^1$ is a group having from 1 to 40, preferably from 1 to 20, more preferably from 2 to 5, carbon atoms. $R^2$ is a group having from 1 to 40, preferably from 16 to 30, more preferably from 18 to 26, carbon atoms.

Typical examples of the compound are shown below.

1)

$$CH_3—(CH_2)_{12}—COO—(CH_2)_{17}—CH_3$$

2)

$$CH_3—(CH_2)_{18}—COO—(CH_2)_{17}—CH_3$$

3)

$$CH_3—(CH_2)_{20}—COO—(CH_2)_{21}—CH_3$$

4)

$$CH_3—(CH_2)_{14}—COO—(CH_2)_{19}—CH_3$$

5)

$$CH_3—(CH_2)_{20}—COO—(CH_2)_6—O—CO—(CH_2)_{20}—CH_3$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

7)

$$CH_3—(CH_2)_{22}—COO—(CH_2)_2—\overset{CH_3}{\overset{|}{CH}}—CH_2—O—CO—(CH_2)_{22}—CH_3$$

8)

$$CH_3—(CH_2)_{22}—COO—CH_2—\underset{CH_3}{\overset{CH_3}{\overset{|}{\underset{|}{C}}}}—CH_2—O—CO—(CH_2)_{22}—CH_3$$

-continued

9)

$$CH_3—(CH_2)_{26}—COO—CH_2—\underset{CH_3}{\overset{CH_3}{\overset{|}{\underset{|}{C}}}}—CH_2—O—CO—(CH_2)_{26}—CH_3$$

10)

$$\begin{array}{l} CH_2—O—CO—(CH_2)_{26}—CH_3 \\ | \\ CH—O—CO—(CH_2)_{26}—CH_3 \\ | \\ CH_2—O—CO—(CH_2)_{26}—CH_3 \end{array}$$

11)

$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)

$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)

$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)

$$\begin{array}{l} CH_2—OH \\ | \\ CH—OH \\ | \\ CH_2—O—CO—(CH_2)_{26}—CH_3 \end{array}$$

15)

$$\begin{array}{l} CH_2—OH \\ | \\ CH—OH \\ | \\ CH_2—O—CO—(CH_2)_{22}—CH_3 \end{array}$$

16)

$$CH_3—(CH_2)_{26}—COO—CH_2—\overset{CH_3}{\overset{|}{C}}—CH_2—O—CO—(CH_2)_{26}—CH_3$$
$$\qquad\qquad\qquad -continued

20)

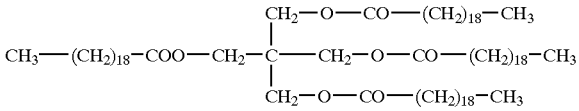

21)

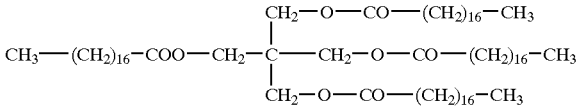

22)

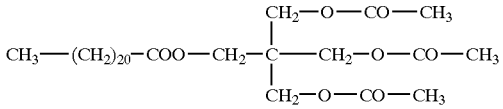

The adding amount of the above compound is from 1 to 30%, preferably from 2 to 20%, more preferably from 3 to 15%, by weight of the whole toner.

It is preferred in the toner of the invention that the mold releasing agent is included in the resin particles by the mini-emulsion polymerization method and then the resin particles are salted out/fusion-adhered together with the colorant particles to form the toner particle.

Charge Controlling Agent

Materials capable of giving various functions to the toner may be added to the toner other than the colorant and the mold releasing agent. Concretely, a charge controlling agent can be used. These materials can be added by various methods such as the method by which the material is added together with the resin particles and the colorant particles at the salting-out/fusion-adhering process to be included in the toner and the method by which the material is added into the resin particle itself.

Various known charge controlling agents capable of being dispersed in water can be used. In concrete, for example, a nigrosine dye, a metal salt of naphthenic acid or a higher fatty acid, an alkoxylized amine, a quaternary ammonium chloride, an azo metal complex and a metal salt of salicylic acid or its metal complex are usable.

External Additive

An external additive may be added to the toner according to the invention for the purpose of improving the fluidity and the cleaning ability. Various kinds of inorganic particle, organic particle and lubricant may be used without any limitation.

Known inorganic particle can be used as the external additive. Fine particles of silica, titania and alumina are preferably usable. These inorganic particles are preferably hydrophilic ones.

Concrete examples of the silica fine particle include R-976, R-974, R-972, R-812 and R-809 each manufactured by Nihon Aerogel Co., Ltd., HVK-2150 and H-200, each manufactured by Hoechst Co., Ltd., and TS-720, TS-530, TS-610, H-5 and MS-5, each manufactured by Cabot Co., Ltd. They are all commercial products.

Concrete examples of the titania fine particle include MT-100S, MT-100B, MT-500BS, MT-600, MT-600SS and JA-1, each manufactured by Teika Co,. Ltd., and TA-300SI, TA-500, TAF-130, TAF-510 and TAF-510T, each manufactured by Fuji Titan Co., Ltd., and IT-S, IT-OA, IT-OB and IT-OC, each manufactured by Idemitsu Kosan Co., Ltd. They are all commercial products.

Concrete examples of the alumina fine particle include RFY-C and C-604, manufactured by Nihon Aerogel Co., Ltd., and TTO-55, manufactured by Ishihara Sangyo Co., Ltd. They are commercial products.

An organic particle having a sphere shape and a number average primary particle diameter of approximately from 10 to 200 nm can be used as the external additive. The material of such the particle is, for example, polystyrene, poly (methyl mthacrylate) or a styrene-methyl methacrylate copolymer.

A metal salt of a higher fatty acid can be used as the external additive. Concrete examples of such the metal salt of higher fatty acid include a metal stearate such as zinc stearate, aluminum stearate, cupric stearate, magnesium stearate and calcium stearate; a metal oleate such as zinc oleate, manganese oleate, ferric oleate, cupric oleate and magnesium oleate; a palmitate such as zinc palmitate, cupric zinc palmitate, magnesium palmitate and calcium palmitate; a linolate such as zinc linolate and calcium linolate; and a ricynolate such as zinc ricynolate and calcium ricynolate.

The adding amount of the external additive is preferably from 0.1 to 5% by weight of the toner.

External Additive Adding Process

The process is a process for adding the external additive to the toner particles.

Various know mixing apparatus such as a tabular mixer, a Henschel mixer, a Nauter mixer and a V-type mixer are usable for adding the external additive to the toner.

Toner Particle

The particle diameter of the toner of the invention is preferably from 3 to 10 $\mu$m, more preferably from 3 to 8 $\mu$m. The particle diameter can be controlled by the control of the concentration of the coagulant, the adding amount of the organic solvent, the time for fusion-adhering and the composition of the polymer in the course of the production.

When the number average particle diameter is within the range of from 3 to 10 $\mu$m, the transfer ability of the toner particles is raised so that the image quality of the half tone, fine line and dot is improved and the fine particle is reduced which has a high adhering force and causes the offset by scattering and adhering to the heating member in the fixing process.

The number average diameter of the toner can be measured by Coulter Counter TA-II, Coulter Multisizer or a laser diffraction particle size measuring apparatus SLAD1100 manufactured by Shimazu Seisakusho Co., Ltd.

In the invention, Coulter Multisizer connected to a personal computer through an interface, manufactured by Nikkaki Co., Ltd., for outputting the particle size distribution. The volume distribution of the toner having a diameter of not less than 2 $\mu$m by Coulter Multisizer using an aperture of 100 $\mu$m and the particle size distribution and the average diameter are calculated.

Preferable Range of Shape Coefficient of Toner

In the toner according to the invention, the particle having a shape coefficient of from 1.0 to 1.6 accounts for not less than 65% in number. It is preferable that the particle having from 1.2 to 1.6 accounts for not less than 65%, particularly not less than 70%, in number. The shape coefficient toner according to the invention is given by the following equation, which shows the sphere degree of the toner particle.

$$\text{Shape coefficient}=((\text{Major diameter}/2)^2\times\pi)/\text{Projective area}$$

The major diameter is the width of the particle defined by the distance of two parallel lines each tangent to the projected image of the toner particle on a plane so that the distance is become to the largest. The projective area is the area of the projected image of the toner on a plane. In the invention, the shape coefficient is determined by photographing the toner particle by a scanning electron microscope with magnification of 2,000, and analyzing the photograph by Scanning Image Analyzer, manufactured by Nihon Denshi Co., Ltd. One hundred toner particles are subjected to the measurement and the shape coefficient is calculated by the above equation.

It is preferable in the toner of the invention that the sum M of a relative frequency of the toner particles included in the highest frequency class $m_1$ and a relative frequency of the toner particles included in the next high frequency class $m_2$ is not less than 70% in a histogram showing a particle diameter distribution in number which is classified into plural classes every 0.23 of natural logarithm ln D graduated on the horizontal axis of the histogram, where D is the diameter of the toner particle in $\mu$m.

When the sum M of the relative frequencies $m_1$ and $m_2$ is not less than 70%, the scatter of the size distribution of the toner particle is become narrow. Consequently, occurrence of the selective development can be certainly inhibited by the use of such the toner.

In the invention, the foregoing histogram showing the size distribution based on the number is a histogram in which the natural logarithm lnD of the diameter D is classified every 0.23 into plural classes 0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76, . . . The histogram is made out by the following procedure: the particle diameter data of the sample measured by Coulter Multisizer under the following condition is transferred to a computer through an I/O unit and the histogram is output by the size distribution analyzing program in the computer.

Measuring Condition

1. Aperture: 100 $\mu$m
2. Sample preparation:
   A suitable amount of a surfactant is added to an amount of from 50 to 100 ml of an electrolyte solution Isoton R-11, manufactured by Coulter Scientific Japan Co., Ltd., and stirred, and then an amount of from 10 to 20 mg of the sample to be measured is added to the solution. This system is subjected to an ultrasonic dispersion treatment for 1 minute to prepare the sample liquid.

Developer

The toner according to the invention may be used either for a one-component developer or a two-component developer.

The one-component developer includes a non-magnetic developer and a magnetic developer contained a magnetic particle having a diameter of approximately from 0.1 to 0.5 $\mu$m in the toner particle. The toner according to the invention can be applied both type of the developers.

The toner according to the invention can be used in the form of two-component developer by mixing with a carrier. In such the case, known materials, for example, a metal such as iron, ferrite, and magnetite, and an alloy of the foregoing metal with another metal such as aluminum and lead can be used as the magnetic particle of the carrier. The ferrite particle is particularly preferred. The magnetic particle having a volume average particle diameter of from 15 to 100 $\mu$m, more preferably from 25 to 80 $\mu$m, is suitable.

The volume average particle diameter of the carrier particle can be measured typically by a laser diffraction particle size distribution measuring apparatus HEROS having a wet type dispersing device, manufactured by Sympatec Co., Ltd.

A carrier composed of the magnetic particle coated with resin or a resin disperse type carrier in which the magnetic particles are dispersed in resin is preferably used. An olefin resin, a styrene resin, a styrene-acryl resin, a silicone resin, an ester resin or a fluorine-containing polymer resin is usable without any limitation. A styrene-acryl resin, a polyester resin a fluorine-containing resin and a phenol resin are usable for constituting the resin dispersion type carrier without any limitation.

Image Forming Method

First, an example of the image forming apparatus according to the invention is described bellow.

Figure 2:
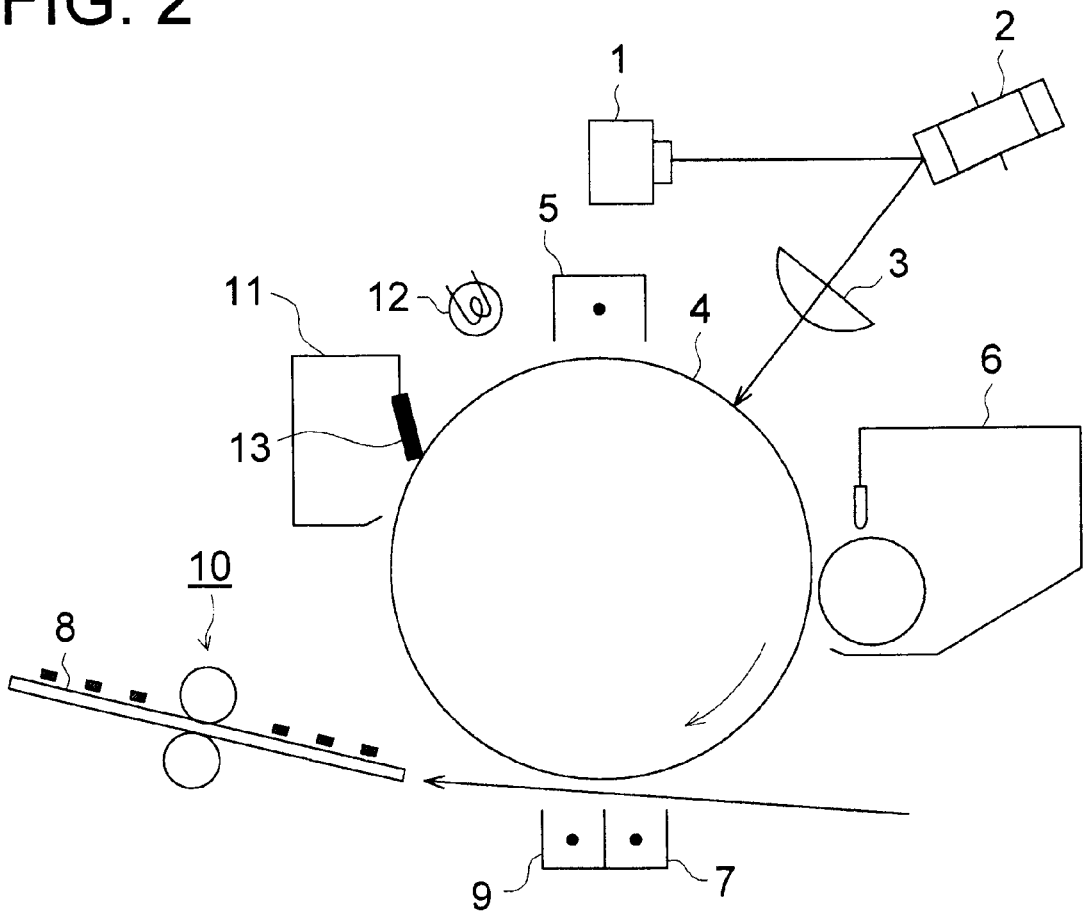
FIG. 2 shows a schematic constitution of the image forming apparatus of an example of the embodiment of the invention.

FIG. 2 is a schematic illustration of the image forming apparatus as an example of embodiment of the invention. In the drawing, 4 is a photoreceptor as a typical example of the static latent image forming device relating to the invention. The photoreceptor comprises an aluminum drum substrate and an organic photoconductive layer (OPC) as the photosensitive layer provided on the external surface of the drum substrate. The drum is rotated in the direction of the arrow in a prescribed speed. The external diameter of the photoreceptor 4 is 60 mm in this embodiment.

In FIG. 2, a light beam for exposure is generated from a laser light source 1 according to image information lead by an original image leading device which is not shown in the drawing. The light beam is distributed by a polygon mirror to the perpendicular direction to the drawing paper and irradiated to the photoreceptor surface through an fθ lens for calibrating the distortion of the image to form a static latent image. The photoreceptor is previously charged by a charging device 5 and rotated clockwise synchronized with timing of the image exposure.

The static latent image on the photoreceptor is developed by a developing device 6. The developed image is transferred onto a recording material 8 conveyed according to adjusted timing by the effect of a transfer device 7. The recording material 8 is separated from the photoreceptor 4 by a separating device or a separating electrode 9. The developed toner image is transferred and carried on the recording material and introduced into a fixing device 10 so as to be fixed.

The toner not transferred and remained on the photoreceptor surface is removed by a cleaning blade type cleaning device 11. After the cleaning, remained charge of the photoreceptor is removed by a precharging light exposure (PCL) 12. Then the photoreceptor is uniformly charged again by the charging device 5 for next image formation.

Although the recording material is typically a sheet of paper, any material on which the non-fixed developed image can be transferred can be used without any limitation. PET base for OHP is usable of course.

A rubber-like material having a thickness of approximately from 1 to 30 mm is used as cleaning blade 13. Urethane rubber is usually used as the material of the blade. The cleaning blade is preferably released from the photoreceptor when the image forming operation is not performed since the blade is contacted to the photoreceptor and tends to conduct heat.

Recently, a image forming method using a digital system is actively investigated in the field of the electrophotography in which a latent image is formed on the photoreceptor and developed to form a visible image, since the quality improvement, conversion and edition of image can be easily performed and a high quality image can be obtained by the digital image forming system.

As the optical scanning system in which light is modulated by a digital image signal from a computer or an original picture to be copied, (1) an apparatus in which a sonic optical modulator is inserted in the laser optical system and light is modulated by the modulator, and (2) an apparatus using a laser for directly modulating the laser light, are used. The charged photoreceptor is exposed to a light spot irradiated from such the scanning optical system to form a dot image.

The light beam irradiated from the scanning optical system has a spherical or elliptical luminance distribution like a normal distribution with an extended foot. In the case of laser beam, the shape of the light spot is very small sphere or ellipse having a diameter in the main scanning or sub-scanning or both directions of, for example, from 20 to 100 μm.

The image forming apparatus may be constituted so that a processing cartridge is installed therein, which contains at least one of the photoreceptor 4, the charging device 5, the developing device 6, the cleaning device 11 and the transfer device 7.

The toner according to the invention is suitably applied an image forming apparatus having a fixing process for fixing the recording material carrying the toner image is passed between a heating roller and a pressure roller constituting the fixing device.

Figure 3:
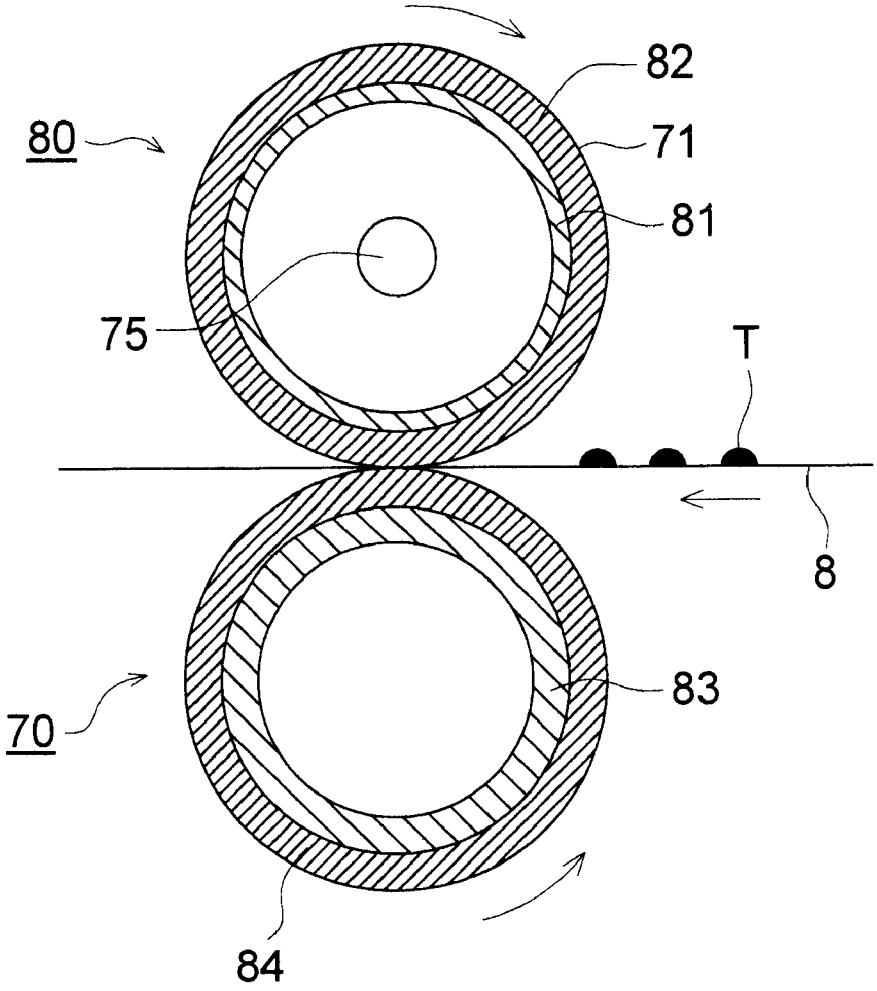
FIG. 3 shows a cross section of an example of the fixing device to be used in the invention.

FIG. 3 shows a cross section of an example of the fixing device to be used in the image forming apparatus using the toner according to the invention. The fixing device shown in FIG. 3 has a heating roller 80 and a pressure roller 70 contacting with the heating roller. In FIG. 3, T is a toner image formed on a recording material or an image support 8.

The heating roller 80 is composed of a metal core 81 and a covering layer 82 comprising a fluorinated resin or an elastic material and covering the surface of the metal core, and a heating member 75 composed of a line heater is included in side of the metal core.

The metal core 81 is composed of a metal and the external diameter thereof is from 10 to 70 mm. The metal of the metal core 81 is not specifically limited, and examples of suitably usable metal include iron, aluminum and copper, and an alloy thereof.

The thickness of the metal core 81 is from 0.1 to 15 mm which is decided on the balance of the requirement energy saving (reducing the thickness) and the strength depending on the material of the metal core. For example, an aluminum metal core with a thickness of 0.8 mm is necessary to hold the strength of an iron metal core with a thickness of 0.57 mm.

Example of the fluorinated resin for forming the surface layer 71 of the covering layer 82 include polytetrafluoroethylene (PTFE) and tetrafluoroethylene-perfluoroalkyl vinyl ether copolymer.

The thickness of fluorinated resin surface layer 71 is from 10 to 150 μm, preferably from 20 to 400 μm.

When the thickness of the surface layer 71 of the covering layer is less than 10 μm, the ability of the surface layer cannot be sufficiently displayed, and the durability of the fixing cannot be maintained. Besides, when the thickness exceeds 500 μm, the surface thereof tends to be scratched by paper powder and the toner adhered on the scratch causes a contamination of the image.

As the elastic material constituting the covering layer 82, a silicone rubber having a high heat resistively such as LTV, RTV and HTV and a silicone rubber sponge are preferably usable.

The Ascar hardness of the elastic material constituting the cover layer 82 is less than 80°, preferably less than 60°.

The thickness of the covering layer 82 composed of the elastic material is from 0.1 to 30 mm, preferably from 0.1 to 20 mm.

When the Ascar hardness of the elastic material of the covering layer 82 exceeds 80° or the thickness of the covering layer 82 is less than 0.1 mm, the effect of the soft fixing such as improvement of the color reproducibility by the toner layer having a smoothed interface cannot be obtained since the nip of the rollers of the fixing device cannot be made wide.

A halogen heater is suitably used as the heating member 57. The pressure roller comprises the metal core 83 and the covering layer 83 of the elastic material provided on the metal core. There is no limitation on the elastic material constituting the covering layer 84 and, for example, various kinds of soft rubber and rubber sponge are usable. The silicone rubber and silicone rubber sponge described as the examples of material for the covering layer 82 are preferably used.

The Ascar hardness of the elastic material constituting the cover layer 84 is less than 80°, preferably less than 70°, more preferably less than 60°.

The thickness of the covering layer 84 is from 0.1 to 30 mm, preferably from 0.1 to 20 mm.

When the Ascar hardness of the elastic material of the covering layer 84 exceeds 80° or the thickness of the covering layer 84 is less than 0.1 mm, the effect of the soft fixing cannot be obtained since the nip of the rollers of the fixing device cannot be made wide.

The metal of the metal core 83 is not specifically limited, and examples of the metal include iron, aluminum and copper, and an alloy thereof.

The contacting load or total load between the heating roll 80 and the pressure roller 70 is usually from 40 N to 350 N, preferably from 50 to 300 N, more preferably from 50 to 250 N. The contacting load is decided considering the strength, namely the thickness of the metal core 81, of the heating roller 80. For example, a load less than 250 N is preferable as to the heating roll having an iron metal core of 0.3 mm.

The nip width is preferable from 4 to 10 mm and the face pressure at the nip is preferably from $0.6\times10^5$ to $1.5\times10^5$ Pa from the viewpoint of the anti-offset ability and the fixing ability.

In an example of the fixing condition of the fixing device shown in FIG. 3, the fixing temperature or the surface temperature of the heating roller 80 is from 150 to 210° C. and the line speed of fixing is from 80 to 640 mm/sec.

A cleaning mechanism may be added to the fixing device used in the invention when it is necessary. In such the case, a method by which silicone oil is supplied by a pad, a roller or a web each immersed with the silicone oil may be sued for supplying the silicone oil to the upper roller or heating roller of the fixing device.

Silicone oil with a high heat resistively such as polydimethylsilicone, polyphenylmethyl silicone and polydimethylsilicone is used. Silicone oil having a viscosity of from 1 to 100 Pa·s is suitably used since one having a low viscosity is excessively flow out at the supplying time.

The effect of the invention is considerably enhanced when the image forming process includes a process using the fixing device in which no or extremely small amount of silicone oil is supplied. Therefore, the supplying amount of the silicone oil is preferably not more than 2 mg per sheet of A4 size paper.

The amount of the silicone oil adhered on the recording paper or the image support is reduced by making the supplying amount of the silicone oil to not more than 2 mg per sheet of A4 size paper. Consequently, a difficulty of writing by an oily ink such as a ball point pen caused by the silicone oil is not occurred and the retouching ability is not degraded.

Moreover, problems such as degradation of the anti-offset ability caused by the deterioration of the silicone oil during a long lapse and contamination of the optical system and the charging electrode by the silicone oil can be avoided.

The supplying amount is calculated by Δw/100 wherein Δw is the different of the weight of the fixing device caused by passing of 100 sheets of the blank A4 size recording paper between the rollers of the fixing device at the prescribed temperature.

EXAMPLES

The invention is concretely described referring examples below. The embodiment of the invention is not limited to the examples.

Preparation of Toner and Developer

1. Preparation of latex

Preparation of Latex 1HLM

1: Preparation of Core Particle (The First Step of Polymerization)

In a 5,000 ml separable flask with a stirrer, a thermal sensor, a cooler and a nitrogen supplying apparatus, a surfactant solution composed of 3,010 g of ion-exchanged water and, dissolved therein, 7.08 g of anionic surfactant A, $C_{10}H_{21}(OCH_2CH_2)_2OSO_3Na$, was charged as an aqueous medium. The temperature of the content was raise by 80° C. while stirring at 230 rpm under a nitrogen gas stream.

Into the surfactant solution, an initiator solution composed of 9.2 g of polymerization initiator, potassium persulfate KPS, dissolved in 200 g of ion exchanged water and the temperature of the content was adjusted to 75° C. Then a monomer mixture liquid composed of 70.1 g of styrene, 19.9 g of n-butyl acrylate and 10.9 g of acrylic acid was dropped into the solution spending 1 hour. This system was heated and stirred for 2 hours for carrying out polymerization or the first step of polymerization. Thus latex, a dispersion of resin particle comprising a polymer resin, was prepared. The latex was referred to as Latex H.

2: Formation of Interlayer (The Second Step of Polymerization)

In a flask with a stirrer, 72.0 g of Exemplified Compound 19 was added as a mold releasing agent to a monomer mixture liquid composed of a 105.6 g of styrene, 30.0 g of n-butyl acrylate, 6.4 g of acrylic acid and 5.6 g of n-octyl-3-mercaptopropionic acid ester. The content was heated at 80° C. for dissolving the mold releasing agent. Thus Monomer Solution 1 was prepared.

Besides, a surfactant solution composed of 2700 ml of ion exchanged water and, dissolved therein, 1.6 g of the foregoing anionic Surfactant A was heated by 80° C. and 28 g in terms of the solid ingredient of the dispersion of the core particle Latex 1H was added to the surfactant solution. Then the foregoing Monomer Solution 1 was mixed and dispersed into the surfactant solution containing Latex 1H by a mechanical dispersing machine Cleamix having a circulation channel, manufactured by M-Tech Co., Ltd., to prepare an emulsion which contains emulsified particles having a uniform particle size of 284 nm.

Then, an initiator solution composed of 240 ml of ion-exchanged water and, dissolved therein, 5.1 g of the polymerization initiator KPS and 750 ml of ion-exchanged water was added to the emulsion. This system was heated and stirred at 80° C. for 3 hours for carrying out polymerization, the second step of polymerization. Thus latex, a dispersion of a combined resin particle comprising the high molecular weight resin particle covered by an intermediate molecular weight resin was prepared. This latex was referred to as Latex 1HM.

3: Formation of Outer Layer (The Third Step of Polymerization)

To the foregoing Latex 1HM, an initiator solution composed of 200 ml of ion-exchanged water and, dissolved therein, 7.4 g of the polymerization initiator KPS was added and a monomer mixture of 300 g of styrene, 95 g of n-butyl acrylate, 15.3 g of methacrylic acid, and 10.4 g of n-octyl-3-mercaptopropionic acid ester was dropped spending 1 hour under a condition of 80° C.

After the dropping, polymerization, the third step of polymerization was carried out by heating and stirring for 2 hours. Then the reaction liquid was cooled by 27° C. Thus latex, a dispersion of resin particle having the core, inter layer and outer layer, was obtained. The latex was referred to as Latex 1HML.

The combined resin particle of Latex 1HML has peaks of molecular weight distribution at 138,000, 80,000 and 13,000, and the weight average particle diameter of the resin particle was 122 nm.

Preparation of Latex 2HML

Latex 2HML was prepared in the same manner as in Latex 1HML except that an anionic Surfactant B, sodium dodecylsulfonate SDS, was used in place of anionic Surfactant A.

The combined resin particle of Latex 2HML has peaks of molecular weight distribution at 138,000, 80,000 and 12,000, and the weight average particle diameter of the resin particle was 110 nm.

Preparation of Toner

Preparation of Toner Particle

Preparation of Toner 1

In 1,600 ml of ion-exchanged water, 59.0 g of anionic Surfactant A was dissolved by stirring. To the solution, 420.0 g of Carbon black Regal 330, manufactured by Cabot Co., Ltd., was gradually added and dispersed by Clearmix, manufactured by M-Tech Co., Ltd., to prepare a dispersion of the colorant particle. The dispersion of the colorant was referred to as Colorant Dispersion 1. The weight average diameter of the colorant particle in Colorant Dispersion 1 was 98 nm according to the measurement by electrophoresis light scattering photometer ELS-800, manufactured by Ootsuka Denshi Co., Ltd.

In a four mouth flask as the reaction vessel to which a thermal sensor, cooler, nitrogen conduction apparatus and stirrer were attached, 420.7 g in terms of solid component of the foregoing Latex 2HML, 900 g of ion-exchanged water 166 g of Colorant Dispersion 1 were charged and stirred. The content was heated by 30° C. and the pH of the liquid was adjusted to 9.0 by the addition of a sodium hydroxide solution having a concentration of 5 moles/liter.

Then an aqueous solution of 12.1 g of magnesium chloride dissolved in 1,000 ml of ion-exchanged water was added to the foregoing liquid spending 10 minutes while stirring. Thereafter, the liquid was stood for 3 minutes and heated up by 9° C. spending 6 minutes with a temperature raising rate of 10° C./minute.

In that the state, the diameter of the associated particle was measured by Coulter-Counter TA-II, manufactured by Coulter Co., Ltd., and the growing of the particle is stopped at the time at which the number average particle diameter was reached at 5.5 μm by adding a solution of 80.4 g of sodium chloride in 1,000 ml of ion-exchanged water. The system is further stirred at 85° C. for 2 hours to continue the adhesion as a ripening treatment.

Thereafter, the system was cooled by 30° C. at a cooling speed of 8° C./minute, and 20 μl of Perfume 1 and 10 μl of Perfume 2 was added as shown in Table 1. Moreover, pH was adjusted to 2.0 by hydrochloric acid and the stir was stopped. Thus formed associated particles were filtered by a Nutsche funnel and repeatedly washed by ion-exchanged water of 45° C. To the associated particles on the Nutsche funnel, 10 g of the deodorant shown in Table 1 dissolved in 2 kg of ion-exchanged water was poured and filtered. Then the particles were dried by air heated at 40° C. To the dried particles, 0.8 parts by weight of hydrophobic silica and 1.0 pat by weight of hydrophobic titania were added. The mixture was mixed by a Henschel mixer for 25 minutes at a circumference speed of rotating wing of 30 m/sec. Thus Toner 1 was obtained.

Toners 2 through 9 and Comparative Toners 1 through 3 each having the constitution shown in Table 1 were prepared in the similar manner to the preparation of Toner 1.

Deodorant 1: Deodorant of Plant Extract

Deodorant 1 was prepared by dissolving 10 g of deodorant F118, a deodorant of plant extracts, available in the make, manufactured by Fine 2 Co., Ltd., in 2 kg of ion-exchanged water at 40° C.

Deodorant 2: Deodorant Containing Phytontid as Plant Extracts

Deodorant 2 was prepared by dissolving 10 g of Biodash, a deodorant of plant extracts, available in the make, manufactured by Daiso Co., Ltd., in 2 kg of ion-exchanged water at 40° C.

Deodorant 3: Deodorant Containing Catechin and Flavonoid as Plant Extracts

Fifty grams of raw tea leaf was crushed into granule having a particle size of not more than 1 mm. The crushed raw leaf was extracted by 200 ml of 50% ethanol aqueous solution at 60° C. to prepare Extract 1. Extract 1 contained 2% by weight of effective ingredient, 50% by weight of ethanol and 48% by weight of water.

Besides, ethanol Extract 2 was prepared using bean sprouts and unripe apple as plants having a high content of flavonoid. In concrete, 30 g of the bean sprouts and 50 g of the unripe apple were immersed in 100 ml of water to prepare a plant extract. To 100 ml of thus obtained extract, 200 ml of the foregoing Extract 1 was added to prepare ethanol Extract 2 containing catechin and flavonoid. Ethanol Extract 2 contained 6% by weight of effective ingredients, 36% by weight of ethanol and 58% by weight of water. Ethanol Extract 2 was dissolved in 2 kg of ion-exchanged water to prepare a deodorant. Thus obtained deodorant was referred to as Deodorant 3.

Deodorant 4: Enzyme Type Deodorant

Deodorant 4 was prepared by dissolving 5 g of Biodash P·500, a deodorant available in the market, manufactured by Daiso Co., Ltd., in 2 kg of ion-exchanged water at 40° C.

Deodorant 5: Enzyme Type Deodorant Containing Plant Extract

Deodorant 5 was prepared by dissolving 5 g of Bio C, manufactured by Console Cooperation, in 2 kg of ion-exchanged water at 40° C. Bio C is an enzyme type deodorant containing plant extract ingredient and available in the market.

Deodorant 6: Metal Phthalocyanine Type Deodorant

Deodorant 6 was prepared by dissolving 1% by weight octacaroboxyferrophthalocyanine in an aqueous solution of an alkali.

Deodorant 7: Artificial Enzyme Deodorant

A cationic group was introduced in β-cyclodextrin by reaction of a mixture of 10 g of β-cyclodextrin and 25 g of 3-chloro-2-hydroxypropyltrimethylammonium chloride at a pH value of 9.0 and a temperature of 70° C.

Three grams of octacarboxyferrophthalocyanine was dissolved in 100 ml of a 0.1% aqueous solution of sodium hydroxide and the pH of the solution was adjusted to 8.0 by acetic acid. The foregoing β-cyclodextrin, in which the cationic group was introduced, was added to the above solution. The mixture was uniformly mixed and heated by 90° C. and reacted for 60 minutes to obtain the subjective artificial enzyme solution.

Deodorant 7 was prepared by diluting the 100 ml of thus obtained artificial enzyme solution by 2 kg of ion-exchanged water.

Deodorant 8: Microbe Deodorant 1

The following components were mixed and stirred for 24 hours at 30° C.

| | |
|---|---|
| Ammonium chloride | 0.5 g |
| Glucose | 5.0 g |
| Water | 2.5 1 |
| Microbe powder: *Bacillus subtilis* | 5.0 g |

The culture medium was subjected to centrifugal separation and the supernatant was referred to as Deodorant 8.

TABLE 1

| | Toner | Perfume 1 | Perfume 2 | Deodorant |
|---|---|---|---|---|
| Example 1 | Toner 1 | Linalyl acetate | Amylis oil | Deodorant 2 |
| Example 2 | Toner 2 | 14-Tetradecanolide | α-Pinene | Deodorant 1 |
| Example 3 | Toner 3 | 1,8-cineol | 3-propylcyclopentadecanone | Deodorant 3 |
| Example 4 | Toner 4 | Cyclopentadecanone | 9-hexadecene-16-olide | Deodorant 4 |
| Example 5 | Toner 5 | Eugenol | α-terpeneol | Deodorant 6 |
| Example 6 | Toner 6 | Geranyl acetate | Eucalyptus lemon | Not used |
| Example 7 | Toner 7 | Gelaniol | Cedrol | Not used |
| Example 8 | Toner 8 | Cyclohexadecanone | Amilis oil | Deodorant 7 |
| Example 9 | Toner 9 | Cycloheneicosane | Amilis oil | Deodorant 5 |
| Comparative example 1 | Comparative toner 1 | Lemon grass oil | Not used | Not used |
| Comparative example 2 | Comparative toner 2 | Eugenyl acetate | Decenal | Deodorant 8 |
| Comparative example 3 | Comparative toner 3 | Not used | Not used | Not used |

Preparation of Developer

A developer was prepared by mixing each of the colored toners mixed with the carrier. The concentration of the toner was 6% by weight.

For evaluation, the photoreceptor and each of the developer were charged into the digital copying machine having the image forming process shown in FIG. 2 which has the corona charging device, laser exposing system, reversal developing device, static transfer device, separating claw and cleaning blade.

The conditions of the digital copying machine were set for the evaluation as follows.

Charging condition

Charging device: Scorontron charging device

Initial charging potential: −750 V

Exposure condition

Exposure amount was set so that the potential at the exposed area was become to −50 V.

Developing condition

DC bias: −550 V

Transfer condition

Transfer electrode: Corona discharge electrode

In the fixing device, a heating roller having an iron core and a cover layer of tetrafluoroethylene-perfluoroalkyl vinyl ether copolymer PFA with a thickness of 25 μm and a surface roughness of Ra of 0.8 μm, and a pressure roller having an iron core and a HTV silicone rubber layer covered with a PFA tube with a thickness of 120 μm and a surface roughness of 0.8 μm were provided.

The nip width was 3.8 mm and the line speed was 420 mm/sec. Any cleaning device and silicone oil supplying mechanism were not attached to the fixing device. The fixing temperature was set at 165° C. and controlled according to the surface temperature of the heating roller.

The copying test was performed in a closed room with an area of 19.8 $m^2$, and 10 persons were subjected to Kraepelin test while measuring the brain waves in the room.

Brain waves of from 8 to 13 Hz appeared at the back of the head or α-Waves were measured as an indicator of relaxation.

The addition calculation work progression coefficient was evaluated by an average value of the 10 subject persons at 30 minutes after the start of the work.

The Kreapelin test known as a method for measuring the efficiency of the calculating work is called as "Continuous primary adding calculation work", in which an adding calculation of one-digital numbers is performed.

The calculation work for 15 minutes was performed twice, 30 minutes in total, before and after a rest for 5 minutes. Such the procedure is the most usually applied as the mental work loading test for evaluation the work efficiency.

TABLE 2

| | Cosθ as to odor of n-butyl acrylate | Cosθ as to odor of styrene | Cosθ as to odor of mercaptocaroxylic acid |
|---|---|---|---|
| Example 1 | 0.99 | 0.996 | 0.997 |
| Example 2 | 0.992 | 0.998 | 0.996 |
| Example 3 | 0.988 | 0.994 | 0.998 |
| Example 4 | 0.987 | 0.992 | 0.995 |
| Example 5 | 0.993 | 0.997 | 0.998 |
| Example 6 | 0.988 | 0.991 | 0.997 |
| Example 7 | 0.991 | 0.993 | 0.994 |
| Example 8 | 0.987 | 0.997 | 0.997 |
| Example 9 | 0.994 | 0.996 | 0.999 |
| Comparative example 1 | 0.982 | 0.992 | 0.989 |
| Comparative example 2 | 0.987 | 0.987 | 0.992 |
| Comparative example 3 | 0.996 | 0.999 | 0.981 |

TABLE 3

| | Ratio of subject | Progression coefficient of adding calculation according to Kreapelin test | |
|---|---|---|---|
| | persons generating α-waves | With fragrant according to the invention | Without fragrant |
| Example 1 | 10 persons in 10 persons | 76 | 61 |
| Example 2 | 9 persons in 10 persons | 71 | 62 |

TABLE 3-continued

| | Ratio of subject | Progression coefficient of adding calculation according to Kreapelin test | |
|---|---|---|---|
| | persons generating α-waves | With fragrant according to the invention | Without fragrant |
| Example 3 | 9 persons in 10 persons | 70 | 58 |
| Example 4 | 8 persons in 10 persons | 65 | 59 |
| Example 5 | 8 persons in 10 persons | 66 | 59 |
| Example 6 | 9 persons in 10 persons | 69 | 60 |
| Example 7 | 9 persons in 10 persons | 91 | 62 |
| Example 8 | 9 persons in 10 persons | 70 | 61 |
| Example 9 | 9 persons in 10 persons | 71 | 62 |
| Comparative example 1 | 1 person in 10 persons | 61 | 61 |
| Comparative example 2 | 2 persons in 10 persons | 62 | 61 |
| Comparative example 3 | No person | 60 | 64 |

The ratio of the subject persons generating the α-waves in Examples 1 through is larger than that in Comparative examples 1 through 3. Therefore it is found that efficiency of the calculation efficiency is raised.

According to the invention, the evaluate and design with precision the smell given off from the image forming apparatus such as the copy machine or the printer, which are become to be frequently used near man, and to make the smell to a pleasant smell for man. The evaluation and the design of the toner is previously carried out from the viewpoint of that the pleasant smell is given off in the image forming process since the major cause of the smell given off from the image forming apparatus is the toner for developing the static latent image.

What is claimed is:

1. A toner for developing a static latent image, wherein a smell of the toner has a cos θ of from 0.990 to 0.998 as to the smell of styrene and a cos θ of from 0.986 to 0.994 as to the smell of n-butyl acrylate in the smell space formed by styrene and n-butyl acrylate.

2. A toner for developing a static latent image, wherein a smell of the toner has a cos θ of from 0.990 to 0.998 as to the smell of styrene and a cos θ of from 0.991 to 0.999 as to the smell of mercaptocarboxylic acid ester in the smell space formed by styrene and mercaptocarboxylic acid ester.

3. An image forming apparatus fixing a toner image onto a recording material by heating, wherein the image forming apparatus emits a smell having a cos θ of from 0.990 to 0.998 as to the smell of styrene and a cos θ of from 0.986 to 0.994 as to the smell of n-butyl acrylate in the smell space formed by styrene and n-butyl acrylate.

4. An image forming apparatus fixing a toner image on to a recording material by heating, wherein the image forming apparatus emits a smell having a cos θ of from 0.990 to 0.998 as to the smell of styrene and a cos θ of from 0.991 to 0.999 as to the smell of mercaptocarboxylic acid ester in the smell space formed by styrene and mercaptocarboxylic acid ester.

* * * * *